United States Patent [19]

Watson et al.

[11] Patent Number: 4,877,698

[45] Date of Patent: Oct. 31, 1989

[54] ELECTROPHOTOGRAPHIC PROCESS FOR GENERATING TWO-COLOR IMAGES USING LIQUID DEVELOPER

[75] Inventors: P. Keith Watson, Rochester; Ian D. Morrison, Webster, both of N.Y.; Melvin D. Croucher, Oakville, Canada

[73] Assignee: Xerox Corporation, Stamford, Conn.

[21] Appl. No.: 197,131

[22] Filed: May 23, 1988

[51] Int. Cl.[4] ..... G03G 13/01; G03G 13/10

[52] U.S. Cl. ..... 430/45; 430/119; 430/114; 430/115; 355/326; 355/256

[58] Field of Search ..... 430/42, 45, 119; 355/3 TR, 4

[56] References Cited

U.S. PATENT DOCUMENTS

| | | | |
|---|---|---|---|
| 3,013,890 | 12/1961 | Bixby | 430/109 |
| 3,793,205 | 2/1974 | Metcalfe et al. | 430/114 |
| 4,078,929 | 3/1978 | Gundlech | 430/31 |
| 4,264,185 | 4/1981 | Ohta | 43/4 |
| 4,312,932 | 1/1982 | Hauser et al. | 430/45 |
| 4,476,210 | 10/1984 | Croucher et al. | 430/114 |
| 4,500,616 | 2/1985 | Haneda et al. | 430/45 |
| 4,524,117 | 6/1985 | Maekawa et al. | 430/44 |
| 4,686,163 | 8/1987 | Seung et al. | 430/47 |
| 4,731,634 | 3/1988 | Stark | 355/4 X |

FOREIGN PATENT DOCUMENTS

| | | |
|---|---|---|
| 1225049 | 9/1960 | Fed. Rep. of Germany . |
| 55-124156 | 9/1980 | Japan . |
| 56-87061 | 7/1981 | Japan . |
| 6919431 | 7/1970 | Netherlands . |
| 2169416A | 7/1986 | United Kingdom . |

*Primary Examiner*—J. David Welsh

*Attorney, Agent, or Firm*—Judith L. Byorick

[57] ABSTRACT

A process for generating two-color images comprising: (1) charging an imaging member in an imaging apparatus; (2) creating on the member a latent image comprising areas of high, intermediate, and low potential; (3) providing an electrode having a potential within about 100 volts of that of the intermediate potential, enabling generation of an electric field and a developement zone between the imaging member and the electrode; and (4) developing the latent image by introducing into the development zone a liquid developer composition containing first toner particles of one color and second toner particles of another color, the particles being dispersed in a liquid medium, wherein the second toner particles are attached to the high potential and the first toner particles are attracted to the low potential. Another embodiment of the invention resides in a process for generating two-color images, comprising: (1) creating on an imaging member in an imaging apparatus a latent image comprising areas of positive, negative, and substantially no potential; (2) providing an electrode having a potential within about 100 volts of that of the area of substantially no potential, enabling the generation of an electric field and a development zone between the electrode and the imaging member; and (3) developing the latent image by introducing into the development zone a liquid developer composition containing first toner particles of one color and second toner particles of another color, the particles being dispersed in a liquid medium, wherein the second toner particles are attracted to the positive potential and the first toner particles are attracted to the negative potential.

26 Claims, No Drawings

ELECTROPHOTOGRAPHIC PROCESS FOR GENERATING TWO-COLOR IMAGES USING LIQUID DEVELOPER

BACKGROUND OF THE INVENTION

The present invention is directed to a process for generating two-color images. More specifically, the present invention is directed to a process wherein electrostatic latent images formed on the surface of an imaging member in an imaging device are developed with a liquid developer containing first and second toner particles with opposite polarities, with the first and second toner particles being of different colors. One embodiment of the invention includes the steps of charging an imaging member, creating on the member a latent image comprising areas of high, medium, and low potential, and providing an electrode having a potential within 100 volts of that of the intermediate potential. Subsequently, there is enabled the generation of an electric field and a development zone between the electrode and the imaging member. The aforementioned latent image is then developed by introducing into the development zone a liquid developer composition containing first toner particles of one color and second toner particles of another color, the particles being dispersed in a liquid medium, such that the second toner particles are attracted to the high level of potential and the first toner particles are attracted to the low level of potential, with the intermediate level of potential remaining undeveloped.

Methods of generating two-color electrophotographic images are known. For example, U.S. Pat. No. 4,264,185, the disclosure of which is totally incorporated herein by reference, discloses an apparatus for developing images of two different colors. The apparatus of this patent is used in a development process wherein an electrostatic latent image of two different polarities is created on the imaging member and dry toner particles of opposite polarities, which are kept in two separate housings, are applied to the bipolar latent image for development. Preferably, the two toners are applied sequentially; in all instances, the oppositely charged toner particles must be kept separate to prevent them from attracting each other such that their opposite charges are neutralized and both toners become incapable of developing latent images.

Another reference, U.S. Pat. No. 4,500,616, the disclosure of which is totally incorporated herein by reference, also discloses a method for developing two-color images with dry toner. According to this method, images of both positive and negative polarities are generated on a two-layered imaging member by means of a multi-stylus electrode, followed by development with two toners of different colors and opposite polarity. These two toners are mixed together to form one complex developer composition, and each image is developed under a magnetic bias by a process wherein the toner of one polarity is selectively extracted from a second toner of opposite polarity in the presence of an alternating field. This patent is directed to an imaging method employing multiple pass development.

U.S. Pat. No. 4,524,117, the disclosure of which is totally incorporated herein by reference, also directed to a multiple pass development method, discloses a method for the formation of two-colored images simultaneously. The method comprises uniformly charging a photoreceptor having a photoconductive layer sensitive to a first color, exposing a two-colored original to form on the photoconductive layer a latent image corresponding to a second color region in the original with the same polarity as the electric charges on the surface of the photoconductive layer, subjecting the photoreceptor to reversal development treatment by the use of a photoconductive color toner charged with the same polarity as the electric charges constituting the latent image to develop the non-charged region with the photoconductive color toner, subjecting the latent image to a normal development treatment by the use of an insulative toner having a color different from the color of the photoconductive color toner, and charging the color toners on the photoconductive layer with a different polarity from the charging polarity and simultaneously exposing the original through a filter shielding against the first color, thereby forming a two-color image corresponding to the original. Methods for developing two-color images from latent images of positive and negative polarities by exposing them to two toners of different color and opposite polarity are also disclosed in Japanese Patent No. 56-87061 and Japanese Patent No. 58-48065.

In addition, U.S. Pat. No. 3,013,890, the disclosure of which is totally incorporated herein by reference, discloses a method of producing two-color images in which a charge pattern is developed with a single, two-color dry developer. The developer comprises first and second toner particles of different colors and opposite polarities, and a single carrier capable of supporting both positively charged toner particles and negatively charged toner particles. According to this method, positively charged areas are developed with the negative toner particles, and negatively charged areas are developed with the positive toner particles. When the charge pattern includes both positive and negative polarities, a two-color image results. Further, U.S. Pat. No. 4,312,932, the disclosure of which is totally incorporated herein by reference, discloses a color dry developing composition which obtains color images utilizing a single pass xerographic imaging system. The composition comprises toner resin particles containing up to four pigments and a single carrier. Corona charging may be used as a method of charging.

Liquid electrophotographic developers are also known. For example, Netherlands Patent No. 6,919,431 discloses a liquid electrophotographic developer containing first and second particles suspended in a liquid carrier medium. The first particles are electrical insulators, while the second particles have a tendency to assume the polarity of the field of the image. The first particles tend to adhere to the surface of the image, while the second particles tend to be repelled, which leads to uniform development and no depositing of developer in non-image areas.

German Patent No. 1,225,049 discloses a process for producing a liquid electrophotographic developer by dispersing two oppositely charged toners in a carrier liquid, characterized in that two oppositely charged toners are used and their particles agglomerate to result in a composite particle of reduced charge. In the composite particles thus formed, one part has a positive charge and the other part has a negative charge. The resultant charge depends on which part has the greater charge; in any case, the resultant charge on the composite particle is lower than the individual charges on the original particles. The process disclosed by this patent yields a developer from which a larger number of toner particles are deposited on the latent image than with developers not containing composite particles, which results in improved image density.

Japanese Patent No. 55-124156 discloses a method for developing two-color images with a liquid developer. The developer composition comprises two kinds of insulating liquids of different specific gravities that do not mix with or dissolve in each other, such that two separate phases exist in the solution. One toner is contained in the first liquid, and another toner of different color and opposite polarity with respect to the first toner is contained in a second liquid. Since the liquids maintain separate phases, the two toners of opposite polarities do not attract each other.

Another reference, U.S. Pat. No. 3,793,205, discloses a developer composition comprising an insulating carrier liquid, a developer pigment of one polarity, and a second developer medium of opposite polarity to the first. The second developer medium enhances the deposition of the first pigment onto the imaging areas by increasing its sensitivity and allowing it to be deposited more heavily, and also shields non-imaging background areas from visible contamination.

British Patent Application No. 2,169,416A discloses a liquid developer composition comprising toner particles associated with a pigment dispersed in a nonpolar liquid, wherein the toner particles are formed with a plurality of fibers of tendrils from a thermoplastic polymer. This application also discloses a process for preparing the disclosed liquid developer. In addition, U.S. Pat. No. 4,476,210 discloses a liquid developer composition and a method of making the developer, which developer comprises a marking particle dispersed in an aliphatic dispersion medium, wherein the marking particle comprises a thermoplastic resin core having an amphipathic block or graft copolymeric steric stabilizer irreversibly chemically or physically anchored to the thermoplastic resin core, with the dye being imbibed in the resin core, and being soluble therein and insoluble in the dispersion medium.

Copending U.S. application Ser. No. 197,132, the disclosure of which is totally incorporated herein by reference, also discloses a developer suitable for a process wherein electrostatic latent images formed on the surface of an imaging member are developed in a single step with a liquid developer containing a plurality of first toner particles and a plurality of second toner particles, wherein the first and second toner particles are of opposite polarities and different colors. The developer comprises a resin and a first pigment of one color, second toner particles charged to a polarity opposite to that of the first toner particles and comprising a resin and a second pigment of a color different from that of the first pigment and a charge director. Further, copending U.S. application Ser. No. 197,130, the disclosure of which is totally incorporated herein by reference, discloses a developer suitable for a process wherein electrostatic latent images formed on the surface of an imaging member are developed in a single step with a liquid developer containing a plurality of first toner particles and a plurality of second toner particles, wherein the first and second toner particles are of opposite polarities and different colors. The disclosed developer comprises a liquid medium, first toner particles charged to one polarity which comprise a first dye of one color and polymeric cores to which steric stabilizer polymers have been attached, second toner particles charged to a polarity opposite to that of the first toner particles which comprise a second dye of a color different from the color of the first dye and polymeric cores to which steric stabilizer polymers have been attached, and a charge director. The developers disclosed in these copending applications can be used for the process of the present invention.

The process of charging a photoresponsive imaging member to a single polarity and creating on it an image consisting of at least three different levels of potential of the same polarity is disclosed in U.S. Pat. No. 4,078,929, the disclosure of which is totally incorporated herein by reference. This patent discloses a method of creating two colored images by creating on an imaging surface a charge pattern including an area of first charge as a background area, a second area of greater voltage than the first area, and a third area of lesser voltage than the first area, with the second and third areas functioning as image areas. The charge pattern is developed in a first step with positively charged toner particles of a first color, and, in a subsequent development step, developed with negatively charged toner particles of a second color. Alternatively, charge patterns may be developed with a dry developer containing toners of two different colors in a single development step. According to the teachings of this patent, however, the images produced are of inferior quality compared to those developed in two successive development steps. Also of interest with respect to the tri-level process for generating images is U.S. Pat. No. 4,686,163.

Latent images generated according to the process disclosed in U.S. Pat. No. 4,078,929, hereinafter referred to as tri-level images, usually cannot, it is believed, be developed by sequentially applying two distinct liquid developers of different colors and opposite polarity to the latent images, primarily because of the nature of liquid developers. While dry toners usually acquire charge by contact with carrier beads of opposite charge, liquid toners generally acquire charge by interaction with ionizable components in the liquid. Accordingly, in dry toners, the countercharges are contained on the carrier particles and are held under control by mechanical forces, while in liquid toners the countercharges are molecularly dispersed in the liquid. Thus, when an electric field is applied to a dry developer, only the charged toner particles migrate, and the countercharges do not migrate to the latent image; when an electric field is applied to a liquid developer, however, both the charged toner particles and the countercharges dispersed in the liquid migrate under the field. When tri-level images are developed with a liquid developer, the charged toner particles develop the areas of one bias, the background areas of second bias remain undeveloped, and the countercharges contained within the liquid developer tend to neutralize the areas of the third bias. As a consequence, only a degraded image, that is, an image with reduced contrast potential, remains to be developed by a second liquid developer containing toner particles charged oppositely to the first toner particles.

Accordingly, while the compositions and processes of the above patents are suitable for their intended purposes, a need continues to exist for improved methods of generating two-color electrophotographic images. A need also continues to exist for methods of generating two-color electrophotographic images with liquid developers. In addition, a need continues to exist for methods capable of generating two-color electrophotographic images wherein the latent images are developed in a single step.

SUMMARY OF THE INVENTION

It is an object of the present invention to provide an improved process for generating two-color electrophotographic images.

It is another object of the present invention to provide a process for generating two-color electrophotographic images using liquid developers.

It is yet another object of the present invention to provide a process for generating two-color electrophotographic images wherein the latent images are developed in a single step.

It is a further object of the present invention to provide a tri-level process for generating two-color electrophotographic images, wherein the photosensitive imaging member is charged to a single polarity and the latent image consists of a high level of potential and a low level of potential, and the background areas consist of an intermediate level of potential.

It is a further object of the present invention to provide a tri-level process for generating two-color electrophotographic images, wherein the latent image consists of a positive potential and a negative potential, and the background potential is of substantially no potential.

These and other objects of the invention are achieved by providing a process for generating two-color images comprising: (1) charging an imaging member in an imaging apparatus; (2) creating on the member a latent image comprising areas of high, intermediate, and low potential; (3) providing an electrode having a potential within about 100 volts of that of the intermediate potential, enabling generation of an electric field and a development zone between the imaging member and the electrode; and (4) developing the latent image by introducing into the development zone a liquid developer composition containing first toner particles of one color and second toner particles of another color, the particles being dispersed in a liquid medium, wherein the second toner particles are attracted to the high potential and the first toner particles are attracted to the low potential.

Imaging members suitable for use with the process of the present invention may be of any type capable of maintaining three distinct levels of potential and suitable for use with liquid developers. The imaging member should be of a type that is not subject to attack by the liquid medium component of the developer. Generally, various dielectric or photoconductive insulating material suitable for use in xerographic, ionographic, or other electrophotographic processes may be used, provided that its surface is not subject to attack by the liquid medium selected for the developer composition. Suitable photoreceptor materials include selenium, selenium alloys, amorphous silicon, layered organic materials as disclosed in U.S. Pat. No. 4,265,990, the disclosure of which is totally incorporated herein by reference, and the like.

The photoresponsive imaging member can be negatively charged, positively charged, or both, and the latent image formed on the surface may consist of either a positive or a negative potential, or both. In one embodiment, the image consists of three distinct levels of potential, all being of the same polarity. The levels of potential should be well differentiated, such that they are separated by at least 100 volts, and preferably 200 volts or more. For example, a latent image on an imaging member can consist of areas of potential at 800,400, and 100 volts. In addition, the levels of potential may consist of ranges of potential. For example, a latent image may consist of a high level of potential ranging from about 500 to about 800 volts, an intermediate level of potential of about 400 volts, and a low level ranging from 0 to about 300 volts. An image having levels of potential that range over a broad area may be created such that gray areas of one color are developed in the high range and gray areas of another color are developed in the low range, with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential.

The tri-level latent image may be formed on the imaging member by any various suitable methods, such as those disclosed in U.S. Pat. No. 4,078,929, the disclosure of which is totally incorporated herein by reference. For example, a tri-level charge pattern may be formed on the imaging member by the xerographic method of first uniformly charging the imaging member in the dark to a single polarity, followed by exposing the member to an original having areas both lighter and darker than the background area, such as a piece of gray paper having both white and black images thereon. In a preferred embodiment, a tri-level charge pattern may be formed by optically modulating light as it scans a uniformly charged photoconductive imaging member. Alternatively, the tri-level charge pattern may be formed by uniformly charging a photoconductive imaging member and scanning the member with filtered light. Other electrophotographic and ionographic methods of generating latent images are also acceptable.

Another embodiment of the present invention resides in a process for generating two-color images comprising: (1) creating on an imaging member in an imaging apparatus a latent image comprising areas of positive, negative, and substantially no potential; (2) providing an electrode having a potential within about 100 volts of that of the area of substantially no potential, enabling the generation of an electric field and a development zone between the electrode and the imaging member; and (3) developing the latent image by introducing into the development zone a liquid developer composition containing first toner particles of one color and second toner particles of another color, the particles being dispersed in a liquid medium, wherein the second toner particles are attracted to the positive potential and the first toner particles are attracted to the negative potential. In this embodiment, the positive level of potential is generally from about +100 to about +1200 volts and the negative level of potential is generally from about −1200 to about −100 volts. With respect to the intermediate area of substantially no potential, "substantially no potential" indicates that this region either has no potential or a potential of sufficiently low magnitude so as not to result in development of this area. Generally, there should be at least 100 volts of potential difference between the intermediate area and the positive potential and between the intermediate area and the negative potential. For example, the positive potential could be about +100 volts, the negative potential could be about −150 volts, and the intermediate area could be about −20 volts.

The electrode may be of any type suitable for use in a liquid development system. This electrode is located in the development housing, and should be located from about 0.2 millimeter to about 2 millimeters, and preferably from about 0.5 millimeter to about 0.6 millimeter from the imaging member. The electrode should be maintained at the same polarity and at a voltage close to that of the intermediate level of potential on the imaging member, preferably within 100 volts. Within the development zone created between the electrode and the imaging member, an electric field is created between the electrode and the imaging member, and the difference in potentials between the electrode and the three levels of potential on the imaging member results in the migration of the toner particles to different areas on the imaging member when the liquid developer is introduced into the development zone. Areas of high level potential on the imaging member attract toner particles of one polarity, and areas of low level potential on the imaging member attract toner particles of the other polarity. For example, in one embodiment of the present invention, areas of high level potential on the imaging member attract negatively charged toner particles, since, within the field created in the development zone, these areas appear positive with respect to the electrode. Areas of low level potential on the imaging member attract positively charged toner particles, since, within the field created in the development zone, these areas appear negative with respect to the electrode. Areas of intermediate potential remain undeveloped, since they appear neutral with respect to the electrode.

Liquid developer compositions suitable for developing latent images formed according to the process of the present invention generally contain first and second toner particles of opposite polarity and different colors within a liquid medium. The liquid medium functions as a low conductivity neutral medium in which the other components of the developer are uniformly dispersed. Materials suitable for the liquid medium include hydrocarbons, such as high purity alkanes having from about 6 to about 14 carbon atoms, such as Norpar® 12, Norpar® 13, and Norpar® 15, available from Exxon Corporation, and including isoparaffinic hydrocarbons such as Isopar® G, H, L, and M, available from Exxon Corporation, Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons are preferred liquid media, since they are colorless, environmentally safe, and possess a sufficiently high vapor pressure so that a thin film of the liquid evaporates from the contacting surface within seconds at ambient temperatures. Generally, the liquid medium is present in a large amount in the developer composition, and constitutes that percentage by weight of the developer not accounted for by the other components. The liquid medium is usually present in an amount of from about 80 to about 98 percent by weight, although this amount may vary from this range provided that the objectives of the present invention are achieved.

The toner particles may consist solely of pigment particles, or may comprise a resin and a pigment; a resin and a dye; or a resin, a pigment, and a dye. Suitable resins include poly(ethyl acrylate-co-vinyl pyrrolidone), poly(N-vinyl-2-pyrrolidone), and the like. Other examples of suitable resins are disclosed in U.S. Pat. No. 4,476,210, the disclosure of which is totally incorporated herein by reference. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all availble from Morton Chemical Company, Ajax, Ontario, Bismark Brown R (Aldrich), Neolan Blue (Ciba-Geigy), Savinyl Yellow RLS, Black RLS, Red 3GLS, Pink GBLS, all available from Sandoz Company, Mississauga, Ontario, and the like. Dyes generally are present in an amount of from about 5 to about 30 percent by weight of the toner particle, although other amounts may be present provided that the objectives of the present invention are achieved. Suitable pigment materials include carbon blacks such as Microlith® CT, available from BASF, Printex® 140 V, available from Degussa, Raven® 5250 and Raven® 5720, available from Columbian Chemicals Company Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that it combines well with any polymeric material also included in the developer composition. Pigment particles are generally present in amounts of from about 5 to about 40 percent by weight of the toner particles, and preferably from about 10 to about 30 percent by weight. The toner particles should have an average particle diameter from about 0.2 to about 10 microns, and preferably from about 0.5 to about 2 microns. The toner particles may be present in amounts of from about 1 to about 10, and preferably from about 2 to about 4 percent by weight of the developer composition.

The liquid developer compositions may also contain charge control additives for the purpose of imparting a positive or negative charge to the toner particles. Charge control additives suitable for the present invention include lecithin (Fisher Inc.); OLOA 1200, a polyisobutylene succinimide available from Chevron Chemical Company; basic barium petronate (Witco Inc.); zirconium octoate (Nuodex); aluminum stearate; salts of calcium, manganese, magnesium and zinc with heptanoic acid; barium, aluminum, cobalt, manganese, zinc, cerium, and zirconium octoates; salts of barium, aluminum, zinc, copper, lead, and iron with stearic acid; and the like. The charge control additive may be present in an amount of from about 0.01 to about 3 percent by weight, and preferably from about 0.02 to about 0.05 percent by weight of the developer composition.

In non-aqueous solutions, some surface active materials used as charge control additives are often amphoteric in that the charge they impart to a surface depends upon a balance between the properties of the charge control additive and the surface constituents of the particle. For example, lecithin, a common charge control additive, will charge some particles positively and some particles negatively, depending upon the reactivity of the particle surface. Thus, it is possible to impart opposite charges to different toner particles in the same liquid medium with the same charge control additive, provided that the surfaces of the two particles are properly chosen. When stabilizing polymers are employed to provide the necessary functional groups on the surfaces of the toner particles, the layer of stabilizer may have a thickness of from about 10 to about 1000 Angstroms, and preferably from about 40 to about 200 Angstroms. Suitable stabilizing polymers include poly(2-ethylhexylmethacrylate), poly(isobutylene), polypropylene, and the like.

Stabilizer materials may also be added to the developer composition to prevent excessive flocculation of the toner particles caused by the mutual attraction that results from their opposite polarities. Although the positive and negative toner particles will normally flocculate in the absence of a field, their mutual attraction may be weakened by means of stabilizers, so that they will separate when in the presence of the electric field generated in the development zone. Specific stabilizers that work well with the present invention include polymeric materials that are soluble in the liquid medium. These polymers are attached to the surfaces of the toner particles by means of covalent bonds or by physical adsorption. When the toner particles are composed solely of pigment particles, the stabilizers attach directly thereto; however, when the toner particles comprise both resin and pigment components, the stabilizers will generally be attached to the resin materials within the toner particles. In addition, the stabilizer material may comprise one component that is soluble in the liquid medium, which component is attached to a second component capable of attaching to the toner particle; for example, a stabilizer may consist of a block copolymer, in which one block constitutes the component soluble in the liquid medium and the other block constitutes the portion capable of attaching to the toner particle. Examples of such polymers include Solsperse polymers available from ICF, Crayton G701 polymers available from Shell Chemical Company, and poly(styrene-b-butylene). In either case, in the liquid medium, the polymer molecules extend to form long chains as a result of the solvation forces, or the attraction of the solvent molecules to the polymers. Provided that these polymer chains are of sufficient length, they act as steric stabilizers, and create a repulsive barrier that maintains a sufficient distance between the toner particles to prevent flocculation when the developer composition is under the influence of the development field. Additional examples of suitable polymeric materials include poly(2-ethylhexylmethacrylate), polyisobutylene, polypropylene, polydimethylsiloxane, poly(vinyl toluene), poly(2-ethylhexylmethacrylate-g-N-vinyl-2-pyrrolidone), poly(2-ethylhexyl acrylate-g-ethyl acrylate), and the like. In some instances, the same material can act as both the steric stabilizer and as the charge control additive. Examples of such materials are OLOA 1200 and lecithin. The polymers may have a molecular weight of from about 10,000 to about 100,000 to ensure that the chains are of sufficient length to separate the toner particles. Further details concerning particles having stabilizing copolymers attached thereto and processes for making the same are in U.S. Pat. No. 4,476,210, the disclosure of which is totally incorporated herein by reference.

The developer composition may also contain dispersions of toner particles mixed with carrier particles larger in size than the toner particles. In conventional liquid developers, the countercharge for the toner particles is contained in a diffuse double layer. Carrier particles that contain the countercharges for the toner particles provide the advantage of control in that the carrier particles can be physically controlled by methods such as screening or filtration, or magnetically controlled by methods such as forming the countercharge into a structural element such as a foam roller. Physically controlling the countercharge by placing it on a larger carrier particle or surface eliminates weakening of the development fields by diffusion of toner charge carriers of opposite polarity.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Two liquid developers are prepared as follows. A first black liquid developer is prepared by the addition of 170 grams of an isoparaffinic hydrocarbon commercially available as Isopar® L from Exxon Corporation to a Union Process 01 Attritor containing 1,750 grams of ¼ inch stainless steel balls. The attritor is heated to 110° C. under constant stirring. Subsequently, 20 grams of CPC-343-1, a chlorinated polypropylene available from Eastman Kodak Company, is added to the attritor, followed one hour later by the addition of 6 grams of Mogul L carbon black pigment, available from Cabot Corporation. The resulting mixture is attrited for one hour to disperse the pigment thoroughly in the CPC-343-1 resin-Isopar® L solution. The attritor is then cooled to 30° C. over a period of two hours. Attrition is continued for another two hours at 30° C., after which the attritor is discharged and the particles dispersed in Isopar® L to a 2 percent solids concentration wherein the particles have an average diameter of from about 1 to about 2 microns as determined by electron microscopy. To this dispersion is then added iron naphthenate, available from Nuodex, in an amount of 25 milligrams per gram of the solids in the dispersion, yielding a negatively charged black liquid developer composition having a charge to mass ratio of about 100 microcoulombs per gram, as determined by the known Faraday cage method.

A second magenta liquid developer is prepared by repeating the above process, except that a magenta pigment (Lithol Rubine #2643, available from Dominion Color Company) is substituted for the carbon black. This second magenta developer contains particles with an average diameter of from about 1 to about 2 microns as determined by electron microscopy, and becomes positively charged upon addition of the iron naphthenate in an amount of 25 milligrams per gram of solids in the dispersion. The charge to mass ratio of the developer is about 85 microcoulombs per gram, as determined by the known Faraday cage method.

Subsequently, a 5 mil aluminized polyester sheet is first charged positively on the insulating side with a positively set corotron and then charged negatively on the insulating side with a negatively set corotron to form two parallel coterminus bands of opposite charge about two inches wide, one side charged to +700 volts and the other charged to −700 volts. The charged sheet is mounted conductive side down on a grounded aluminum plate. A second grounded aluminum plate is placed over the first to form a 600 micron wide gap with the aluminized polyester sheet between them. The above prepared two liquid developers are mixed together in a one to one ratio and the mixture is poured between the plates and allowed to drain out under gravity. When the aluminum plates are separated and the polyester sheet examined, the positive band is developed by the black negatively charged toner particles, and the negative band is developed by the magenta positively charged toner particles, as determined by physical observation.

EXAMPLE II

Two liquid developers are prepared as follows. A first liquid developer is prepared by addition of 170 grams of an isoparaffinic hydrocarbon commercially available as Isopar® G from Exxon Corporation, and 12 grams of a poly(ethylene-co-methacrylic acid) copolymer, commercially available as Elvax II 5720 from E.I. DuPont Company, to a Union Process 01 Attritor containing 1,750 grams of ¼ inch stainless steel balls. The attritor is heated to 110° C. under constant stirring, after which 3 grams of Hostaperm Pink E, available from Hoechst, Inc., is dispersed into the solution for one hour. The attritor is then cooled to 30° C. over a period of two hours. Attrition is continued for another two hours at 30° C., after which the attritor is discharged and the particles dispersed in Isopar® G to a 4 percent solids concentration. To 100 milliliters of the aforementioned dispersion is added 12 milligrams of iron naphthenate, which functions as a charge control agent in Isopar® G, yielding a positively charged magenta liquid developer composition. A second liquid developer is prepared by the same process except that Sudan Blue OS, available from Hoechst, Inc., is substituted for the Hostaperm Pink E. This second cyan developer becomes positively charged upon addition of the iron naphthenate.

A mixture containing two parts of the magenta developer and one part of the cyan developer is placed between parallel electrode plates with a 1 centimeter gap. One plate is grounded and the other charged to 3,000 volts for 5 seconds, resulting in formation of a thick magenta layer on one electrode and a thick cyan layer on the other. A portion of the aforementioned 2:1 mixture is then diluted with Isopar® G to a solids concentration of 2 percent by weight and placed between parallel electrode plates with a 1 millimeter gap. One plate is grounded and the other charged to 500 volts for 15 seconds, resulting in formation of a thick magenta layer on one electrode and a thick cyan layer on the other, indicating a color separation of essentially 100 percent for this bipolar developer.

EXAMPLE III

A charged aluminized polyester sheet is prepared as described in Example I, and a mixture containing two parts of the magenta developer and one part of the cyan developer prepared as described in Example II and diluted with Isopar® G to a solids concentration of 2 weight percent is poured between the grounded aluminum electrode and the charged sheet. After separating the two plates, the charged sheet is found to have one band toned magenta and the other band toned cyan.

EXAMPLE IV

Two liquid developers are prepared as follows. A first liquid developer is prepared by the synthesis of a poly(2-ethylhexyl acrylate-g-ethyl acrylate) stabilizing copolymer, followed by formation of poly(ethyl acrylate-co-vinyl pyrrolidone) particles stabilized by poly(2-ethylhexyl acrylate-g-ethyl acrylate), dyeing of the stabilized particles with Orasol Red G, and addition of lecithin as the charge control additive.

Poly(2-ethylhexyl acrylate-g-ethyl acrylate) is prepared as follows. Into 500 milliliters of Isopar® G is dissolved 125 milliliters of 2-ethylhexylacrylate, after which the solution is heated to 75° C. and purged with nitrogen for about 30 minutes. To this solution is then added 1.6 grams of benzoyl peroxide to initiate polymerization, and the polymerization is allowed to proceed at 75° C. under constant stirring for about 16 hours. A solution of poly(2-ethylhexylacrylate) is obtained. To 280 milliliters of this polymer solution is then added 500 milliliters of Isopar® G, and the solution is heated to 75° C. and purged with nitrogen for 30 minutes, after which 1.2 grams of azobisisobutyronitrile is added. After heating for a further 2 hours, 12 milliliters of ethyl acrylate is added to the solution, and polymerization is allowed to proceed at 75° C. for 16 hours, after which a clear solution of the graft copolymer is obtained.

Poly(ethyl acrylate-co-vinyl pyrrolidone) particles stabilized by the above prepared poly(2-ethylhexyl acrylate-g-ethyl acrylate) are prepared as follows. 800 milliliters of the graft copolymer solution prepared as indicated in the preceding paragraph are heated to 70° C. and purged with nitrogen for 30 minutes. Subsequently, 5 grams of azobisisobutyronitrile are added to the constantly stirred solution. After 1 hour, 110 milliliters of ethyl acrylate are added to the solution, and the polymerization reaction is allowed to proceed at 70° C. for a further 16 hours. An additional 2.5 grams of azobisisobutyronitrile is then added to the resulting dispersion, and, after 1 hour, 40 milliliters of N-vinyl-2-pyrrolidone is added to the dispersion. The polymerization reaction is allowed to proceed for an additional 16 hours with constant stirring. A latex of particles having average diameters of from 0.2 to 0.6 micron is obtained as evidenced by electron microscopy.

The solids content of the above prepared latex is adjusted to about 6 percent weight/volume by the addition of Isopar® G to the dispersion. Orasol Red G, available from Ciba-Geigy Corporation, in an amount of 1 gram, is dissolved in 10 milliliters of absolute methanol and filtered through a Whatman number 4 filter paper. The dyed methanol solution is added dropwise to 100 milliliters of the latex with constant stirring. Subsequently, the reaction mixture is maintained at 60° C. for 3 hours, after which the methanol is removed by distillation under a pressure of 2 Torr and the resulting dyed magenta latex is filtered through a wire mesh. Subsequently, the dyed latex is charged with 20 milligrams per gram of solids content of lecithin to produce a magenta liquid developer composition.

A second developer composition is prepared by preparation of a poly(2-ethylhexylmethacrylate-g-N-vinyl-2-pyrrolidone) stabilizing copolymer, followed by formation of poly(N-vinyl-2-pyrrolidone) particles stabilized by poly(2-ethylhexylmethacrylate-g-N-vinyl-2-pyrrolidone), dyeing of the stabilized particles with Orasol Blue 2GLN, and addition of a lecithin charge control additive.

Poly(2-ethylhexylmethacrylate-g-N-vinyl-2-pyrrolidone) is prepared as follows. To 200 milliliters of poly(2-ethylhexyl methacrylate) is added 500 milliliters of Isopar® G, and the solution is heated to 75° C. and purged with nitrogen for 30 minutes, after which 0.3 gram of benzoyl peroxide is added to the solution. After heating for a further 2 hours, 2.0 milliliters of vinyl pyrrolidone is added to the solution and polymerization is allowed to proceed at 70° C. for a further 16 hours, resulting in a clear solution of the graft copolymer.

Particles of poly(N-vinyl-2-pyrrolidone) stabilized by poly(ethylhexyl methacrylate-g-N-vinyl-2-pyrrolidone) are prepared as follows. 700 milliliters of a graft copolymer solution prepared according to the process described above for the first developer are heated to 70° C. and purged with nitrogen for 30 minutes. Subsequently, 1.0 gram of azobisisobutyronitrile is added to the solution, and after a further 1 hour, 230 milliliters of N-vinyl-2-pyrrolidone are also added to the solution. The polymerization reaction is allowed to proceed at 70° C. for a further 16 hours under constant stirring, resulting in a latex of particles having diameters of from 0.2 to 0.6 micron, as evidenced by electron microscopy.

The solids content of the latex prepared as stated in the preceding paragraph is adjusted to about 6 percent weight/volume by the addition of Isopar® G to the dispersion. Orasol Blue 2GLN, available from Ciba-Geigy Corporation, in an amount of 1 gram, is dissolved in 10 milliliters of absolute methanol and filtered through a Whatman number 4 filter paper. The dyed methanol solution is added dropwise to 100 milliliters of the latex with constant stirring. Subsequently, the reaction mixture is maintained at 60° C. for 3 hours, after which the methanol is removed by distillation under a pressure of 2 Torr and the resulting dyed cyan latex is filtered through a wire mesh. Subsequently, the dyed latex is charged with lecithin at a concentration of 20 milligrams per gram of solids content to produce a negatively charged cyan liquid developer composition.

A mixture containing one part of the magenta liquid developer and one part of the cyan developer is placed between parallel electrode plates situated 1 centimeter apart. One plate is grounded and the other is charged to 500 volts for 5 seconds, resulting in the formation of a thick magenta layer on the negative electrode and a thick cyan layer on the positive electrode, indicating that the bipolar developer will separate into its positive and negative components under the conditions of tri-level image formation according to the process of the present invention.

EXAMPLE V

Two liquid developers are prepared by repeating the procedure of Example IV, except that lecithin, in an amount of 30 milligrams per gram of solids, is used as the charge control agent for both developers. The developers are mixed together in a one to one ratio, and a portion of this mixture is placed between parallel electrode plates situated 1 centimeter apart. One plate is grounded and the other is charged to 500 volts for 5 seconds, resulting in the formation of a thick magenta layer on the negative electrode and a thick cyan layer on the positive electrode, indicating that the bipolar developer will separate into its positive and negative components under the conditions of tri-level image formation according to the process of the present invention.

EXAMPLE VI

Two liquid developers are prepared by repeating the procedure of Example IV, except that Basic Barium Petronate, in an amount of 20 milligrams per gram of solids, is used as the charge control agent for both developers. The developers are mixed together in a one to one ratio, and a portion of this mixture is placed between parallel electrode plates situated 1 centimeter apart. One plate is grounded and the other is charged to 500 volts for 5 seconds, resulting in the formation of a thick magenta layer on the negative electrode and a thick cyan layer on the positive electrode.

A Savin 880 copier is modified to enable the generation of tri-level two-color images according to the method of U.S. Pat. No. 4,078,929, the disclosure of which is totally incorporated herein by reference. A tri-level image is formed on the photoreceptor in the 880 copier, the image is toned with a one to one mixture of the two developers of this Example, and the images are transferred to tape. There results a two-color image of cyan and magenta.

These examples are illustrative in nature and are not intended to limit the scope of the invention. Other embodiments of the present invention may occur to those skilled in the art, and these are included within the scope of the following claims.

We claim:

1. A process for generating two-color images, comprising: (1) charging an imaging member in an imaging apparatus; (2) creating on said member a latent image comprising areas of high, intermediate, and low potential; (3) providing an electrode having a potential within about 100 volts of that of said intermediate potential, enabling generation of an electric field and a development zone between said imaging member and said electrode; and (4) developing said latent image by introducing into said development zone a liquid developer composition containing first toner particles of one color and second toner particles of another different color, said particles being dispersed in a liquid medium, wherein said second toner particles are attracted to said high potential and said first toner particles are attracted to said low potential.

2. A process according to claim 1 wherein said imaging member is selected from the group consisting of selenium, selenium alloys, amorphous silicon, and layered organic materials.

3. A process according to claim 1 wherein said high potential is from about 600 to about 1,200 volts, said intermediate potential is from about 300 to about 600 volts, and said low potential is from 0 to about 300 volts.

4. A process according to claim 3 wherein said high potential is from about 400 to about 800 volts, said intermediate potential is about 400 volts, and said low potential is from 0 to about 400 volts.

5. A process according to claim 1 wherein from 0 to about 100 volts separate said high potential from said intermediate potential and from 0 to about 100 volts separate said intermediate potential from said low potential.

6. A process according to claim 1 wherein said electrode is from about 0.2 to about 2 millimeters from said imaging member.

7. A process according to claim 6 wherein said electrode is from about 0.5 to about 0.6 millimeters from said imaging member.

8. A process according to claim 1 wherein said latent image is created by uniformly charging said imaging member in the dark to a single polarity and exposing said imaging member to an original image having a background, areas lighter in color than said background, and areas darker in color than said background.

9. A process according to claim 1 wherein said latent image is created by uniformly charging said imaging member to a single polarity and scanning said imaging member with optically modulated light.

10. A process according to claim 1 wherein said latent image is created by uniformly charging said imaging member to a single polarity and scanning said imaging member with filtered light.

11. A process according to claim 1 wherein said liquid medium is an isoparaffinic hydrocarbon.

12. A process according to claim 1 wherein said liquid medium is selected from the group consisting of alkanes having from about 6 to about 14 carbon atoms.

13. A process according to claim 1 wherein said first toner particles and said second toner particles are from about 0.2 to about 10 microns in average diameter.

14. A process according to claim 1 wherein said liquid developer composition includes charge control additives.

15. A process according to claim 14 wherein said charge control additives are selected from the group consisting of lecithin, Basic Barium Petronate, polyisobutylene succinimide, zirconium octoate, aluminum stearate, and iron naphthenate.

16. A process according to claim 1 wherein said first toner particles comprise a polymeric resin, a sterically stabilizing polymer attached thereto, and a colorant.

17. A process according to claim 1 wherein said second toner particles comprise a polymeric resin, a sterically stabilizing polymer attached thereto, and a colorant.

18. A process according to claim 16 wherein said polymeric resin is selected from the group consisting of poly(ethyl acrylate-co-vinyl pyrrolidone) and poly(N-vinyl-2-pyrrolidone).

19. A process according to claim 17 wherein said polymeric resin is selected from the group consisting of poly(ethyl acrylate-co-vinyl pyrrolidone) and poly(N-vinyl-2-pyrrolidone).

20. A process according to claim 16 wherein said sterically stabilizing polymer is selected from the group consisting of poly(2-ethyl-hexylmethacrylate), poly(isobutylene), polypropylene, poly(styrene-b-butylene), poly(2-ethyl-hexylmethacrylate), polyisobutylene, polypropylene, polydimethylsiloxane, poly(vinyl toluene), poly(2-ethylhexylmethacrylate-g-N-vinyl-2-pyrrolidone), and poly(2-ethylhexyl acrylate-g-ethyl acrylate).

21. A process according to claim 17 wherein said sterically stabilizing polymer is selected from the group consisting of poly(2-ethyl-hexylmethacrylate), poly(isobutylene), polypropylene, poly(styrene-b-butylene), poly(2-ethyl-hexylmethacrylate), polyisobutylene, polypropylene, polydimethylsiloxane, poly(vinyl toluene), poly(2-ethylhexylmethacrylate-g-N-vinyl-2-pyrrolidone), and poly(2-ethylhexyl acrylate-g-ethyl acrylate).

22. A process according to claim 16 wherein said colorant is selected from the group consisting of pigments, dyes, and mixtures thereof.

23. A process according to claim 17 wherein said colorant is selected from the group consisting of pigments, dyes, and mixtures thereof.

24. A process according to claim 1 wherein said latent image is created by an electrophotographic process.

25. A process for generating two-color images, comprising: (1) creating on an imaging member in an imaging apparatus a latent image comprising areas of positive, negative, and substantially no potential; (2) providing an electrode having a potential within about 100 volts of that of said area of substantially no potential, enabling the generation of an electric field and a development zone between said electrode and said imaging member; and (3) developing said latent image by introducing into said development zone a liquid developer composition containing first toner particles of one color and second toner particles of another color, said particles being dispersed in a liquid medium, wherein said second toner particles are attracted to said positive potential and said first toner particles are attracted to said negative potential.

26. A process according to claim 25 wherein positive potential is from about +100 to about +1,200 volts and said negative potential is from about −1,200 to about −100 volts.

* * * * *